United States Patent [19]

Buford et al.

[11] Patent Number: 5,060,564

[45] Date of Patent: Oct. 29, 1991

[54] MEANS TO EXTRACT OIL FROM USED AUTOMOTIVE OIL FILTER

[76] Inventors: Charles G. Buford, 4566 Quail Ridge Rd., Oceanside, Calif. 92056; Thomas J. Dawson, 26291 Roundtree Ct., San Juan Capistrano, Calif. 92675

[21] Appl. No.: 529,501

[22] Filed: May 29, 1990

[51] Int. Cl.[5] ..... B30B 15/16; B30B 9/02; B30B 1/32

[52] U.S. Cl. ..... 100/52; 100/53; 100/116; 100/131; 100/227; 100/245; 100/269 B; 100/902

[58] Field of Search ..... 100/48, 50, 52, 53, 100/116, 131, 132, 214, 227, 240, 245, 255, 269 R, 269 B, 902

[56] References Cited

U.S. PATENT DOCUMENTS

| | | | |
|---|---|---|---|
| 2,403,912 | 7/1946 | Doll | 100/269 B X |
| 2,616,477 | 11/1952 | Scheer et al. | 100/131 |
| 2,737,995 | 3/1956 | Jennings | 100/902 X |
| 2,904,097 | 9/1959 | Cohen | 100/902 X |
| 2,982,200 | 5/1961 | Robertson et al. | 100/902 X |
| 3,025,837 | 3/1962 | Beach | 100/902 X |
| 3,034,422 | 5/1962 | Howell | 100/902 X |
| 3,055,289 | 9/1962 | Komph, Sr. | 100/902 X |
| 3,266,415 | 8/1966 | Palmer | 100/269 B X |
| 3,411,722 | 11/1968 | Webber | 100/902 X |
| 4,927,085 | 5/1990 | Oberg | 100/131 X |

FOREIGN PATENT DOCUMENTS

| | | | |
|---|---|---|---|
| 2527979 | 12/1983 | France | 100/269 B |
| 122108 | 6/1948 | Sweden | 100/269 B |
| 1133117 | 1/1985 | U.S.S.R. | 100/269 B |
| 1237688 | 6/1971 | United Kingdom | 100/902 |

*Primary Examiner*—Philip R. Coe
*Assistant Examiner*—Stephen F. Gerrity
*Attorney, Agent, or Firm*—Duane C. Bowen

[57] ABSTRACT

A press, in an automotive service facility to extract oil from a used automotive oil filter, mounted by brackets on a waste disposal band over an opening in the top of the barrel. An access door to the press having a cam acting on a press control knob to prevent operation of the press when the door is open. A hydraulic cylinder in the press and a plate under the cylinder and oil filters being deposited on the plate and being pressed to extract oil by the hydraulic cylinder lifting the plate against the bottom of the cylinder. The press being powered by low pressure air in the service facility which is converted to high pressure hydraulic pressure by a multiple stroke pumping system that includes a larger diameter air piston, in an air cylinder, attached to a smaller diameter hydraulic piston. An on-off control shaft manually shifted by manual operation of the press control knob. A first surface connected to the control shaft subjected to air pressure and a second smaller surface connected to the control shaft subjected to hydraulic pressure to bring the control shaft to "off" position when a predetermined maximum hydraulic pressure in the hydraulic cylinder is reached. Pumping action controls including an air valve shaft connected to the air piston and an air valve responsive to movement of the air valve shaft alternately to apply pressure to the air piston in a pressure stroke and to relieve pressure from the air piston in an intake stroke when a new supply of hydraulic fluid is intaked.

11 Claims, 7 Drawing Sheets

40
16
32
16
142
236
38
238
34
120
122
146
100
110
30
126
144
84
HYD
OIL
28
128
26
144
138
92
86
42
10
94
AIR
12
88
96
OIL
90
86
44
46
44
14
HYD
OIL
WASTE OIL
FROM FILTER 40
32
16
16
142
236
238
38
38
34
120
AIR
PRESS.
102
146
100
110
126
128
144
144
84
92
138
HYD
OIL
30
28
26
86
USED
OIL
FILTER
94
42
10
12
88
96
46
86
90
HYD
OIL
44
44
14
WASTE OIL
FROM FILTER

MEANS TO EXTRACT OIL FROM USED AUTOMOTIVE OIL FILTER

BRIEF SUMMARY OF THE INVENTION BACKGROUND AND OBJECTIVES

Our invention relates to means in automotive service facilities to extract oil from used automotive oil filters.

During automotive service activities in automotive service facilities new automotive oil filters are installed and old automotive oil filters are discarded. In the past, such discarded oil filters have contained large amounts of used motor oil. This oil in discarded oil filters contributes to soil and water pollution when the filters are added to trash and garbage dumps. It is an objective of our invention to reduce pollution from discarded automotive oil filters by extracting large percentages of oil contained in such oil filters.

Federal laws effective 7/1/90 mandate that at least 75% by weight of oil in discarded automotive oil filters must be extracted from the filters before they are discarded. It is an objective of our invention to provide means to extract oil from used automotive oil filters, the means having an effectiveness meeting Federal requirements.

Other objectives include: to provide an oil extractor using low pressure compressed air as a source of power, using air-to-hydraulic conversion of power, and utilizing a pumping cycle to convert from lower psi air pressure to higher psi oil pressure; to squeeze oil from such oil filters by pressing the oil filters against the bottom of a hydraulic cylinder by a plate drawn by the hydraulic cylinder by a hydraulic piston, and by a piston rod extending from the top of the cylinder; to minimize space in a service facility by mounting the oil extraction equipment on the top of a general purpose waste disposal barrel; to provide a squeezer that will handle the normal range of heights and diameters of oil filters; to provide a squeezer with an access door for insertion and removal of oil filters and with safety means that will shut off power to the squeezer upon opening of that access door; to devise a safety system that limits squeezing pressures to safe limits and which will automatically shut off the equipment when the maximum selected pressure is reached; to provide such oil extraction means economically constructed so that the equipment can be sold for a relatively low price; and to devise instant shut-off means to be operated manually as a "panic button" should need arise.

We will not further elaborate on objectives and advantages of this equipment at this point. The equipment and system of operation will be more specifically detailed in the following description. Further objectives and advantages of our equipment will be included in the description or will be inherent in the equipment and system of operation described, Our invention will be best understood, together with such additional objectives and advantages thereof, from the following description, read with references to the drawings, in which:

FIGURES

DESCRIPTION

Figure 1:
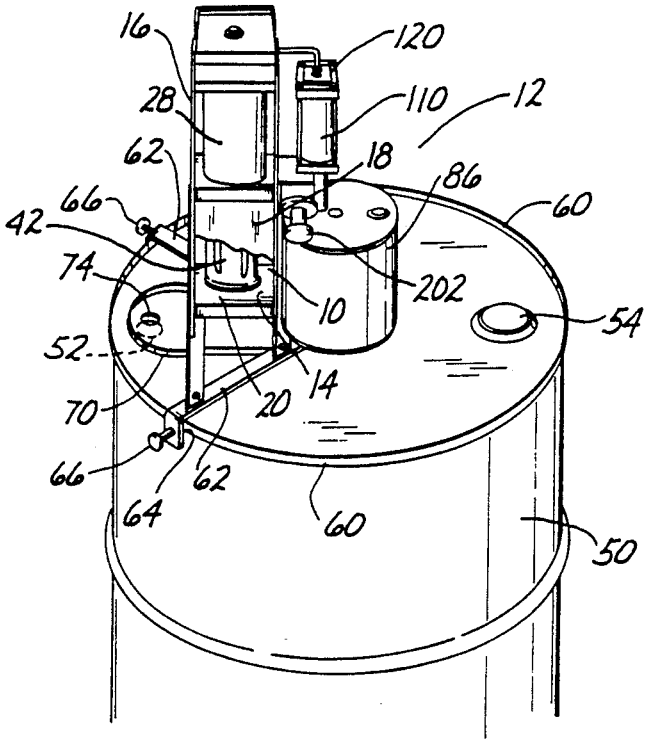
FIG. 1 is a perspective view of a specific embodiment of our invention consisting of a press for used automotive oil filters. The press is shown mounted on an oil disposal barrel.
Figure 2:
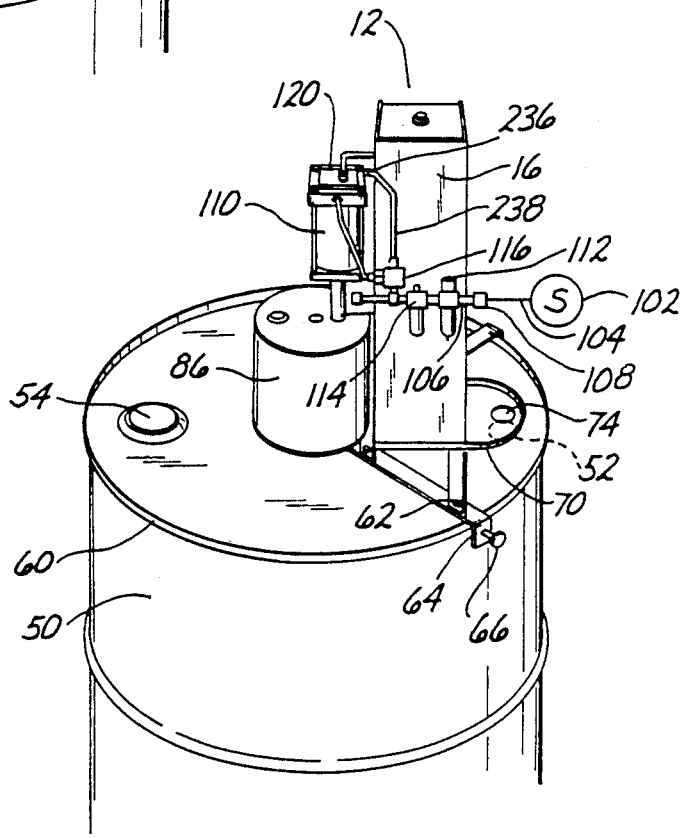
FIG. 2 is like FIG. 1 but is taken from a viewpoint generally diametrically opposite to the viewpoint in FIG. 1.
Figure 3:
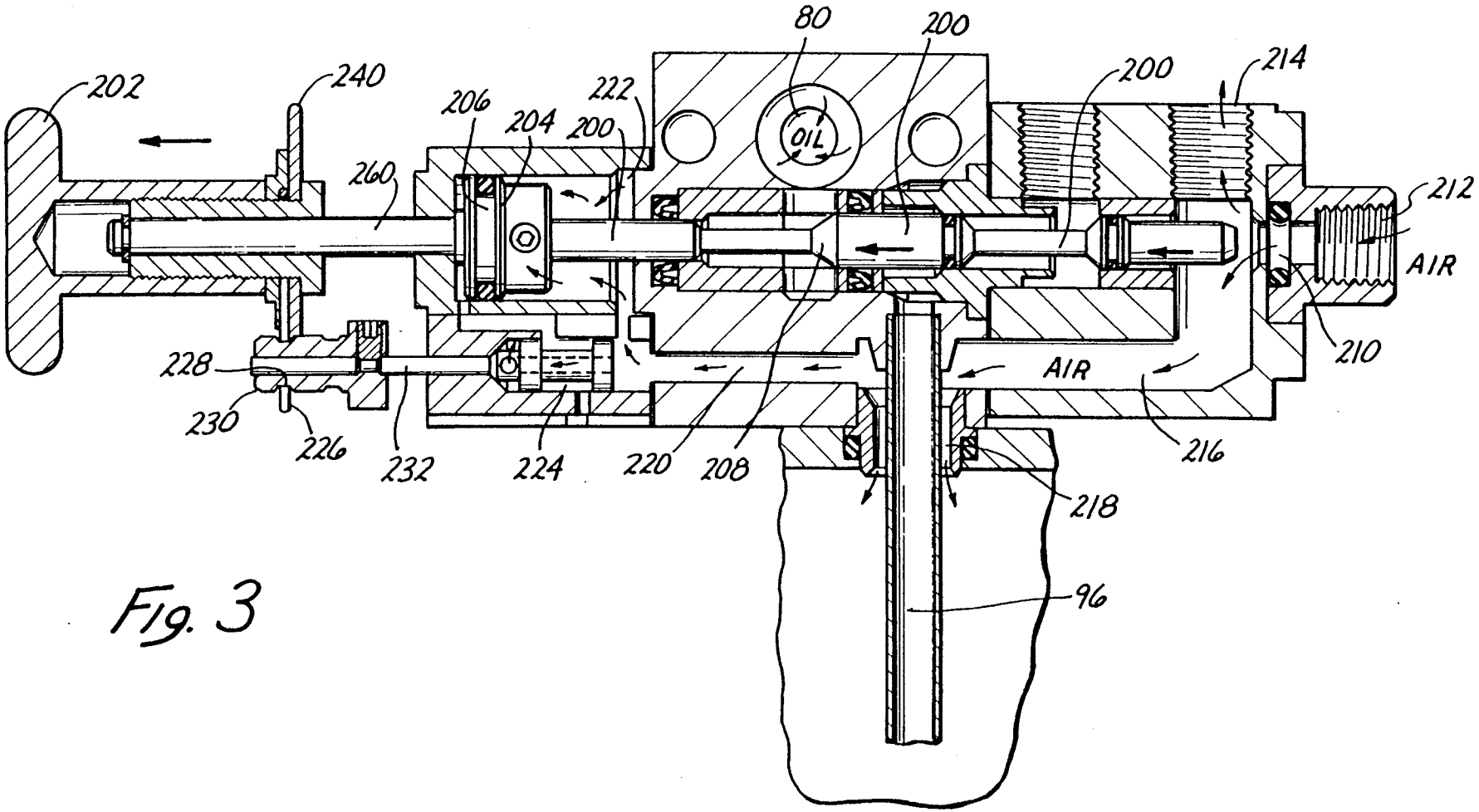
FIG. 3 is an enlarged elevational view, partly in section, taken of the control for the press in "on" position.
Figure 4:
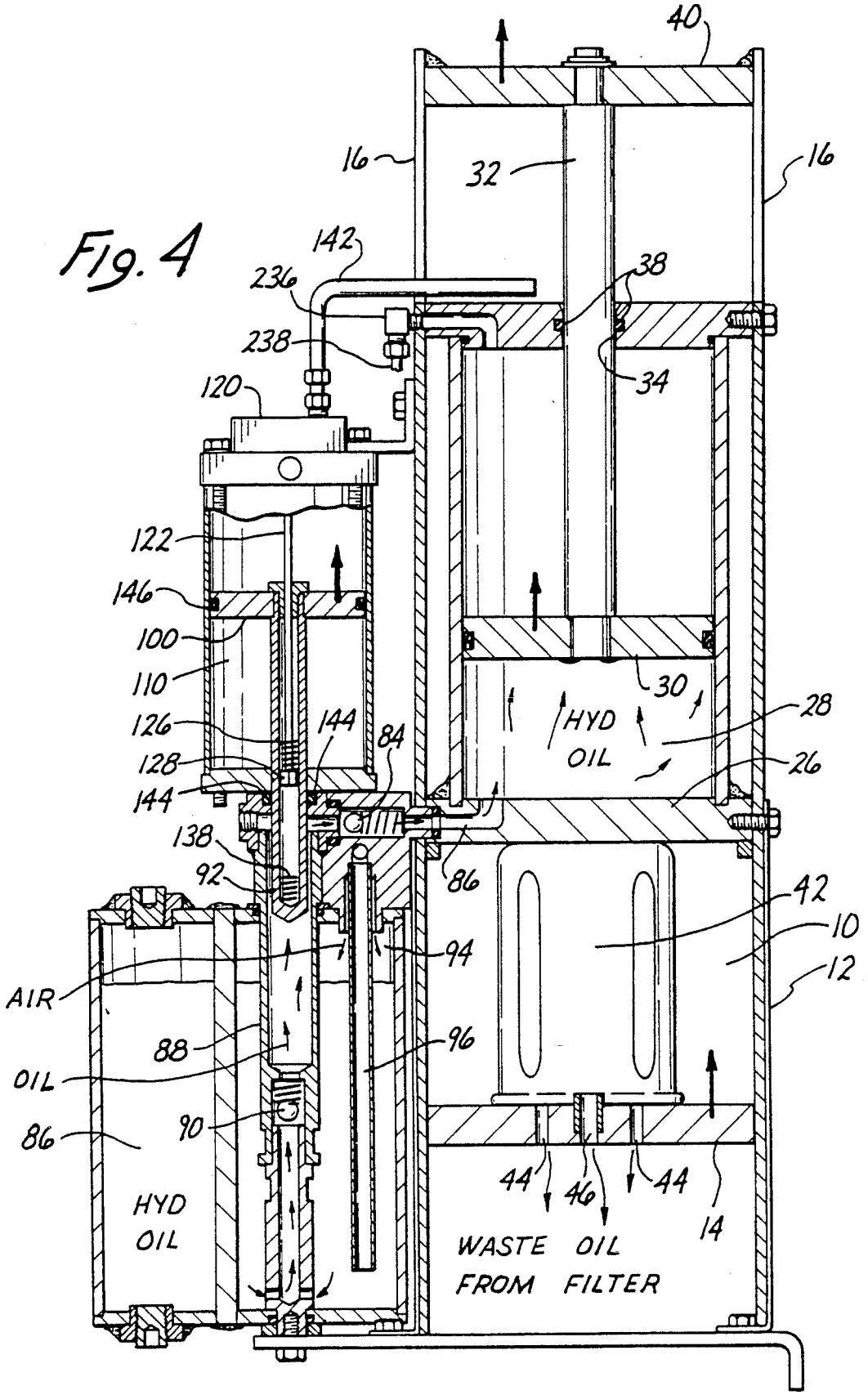
FIG. 4 is an enlarged elevational view, partly in section, taken of oil and air cylinder operating assemblies.
Figure 5:
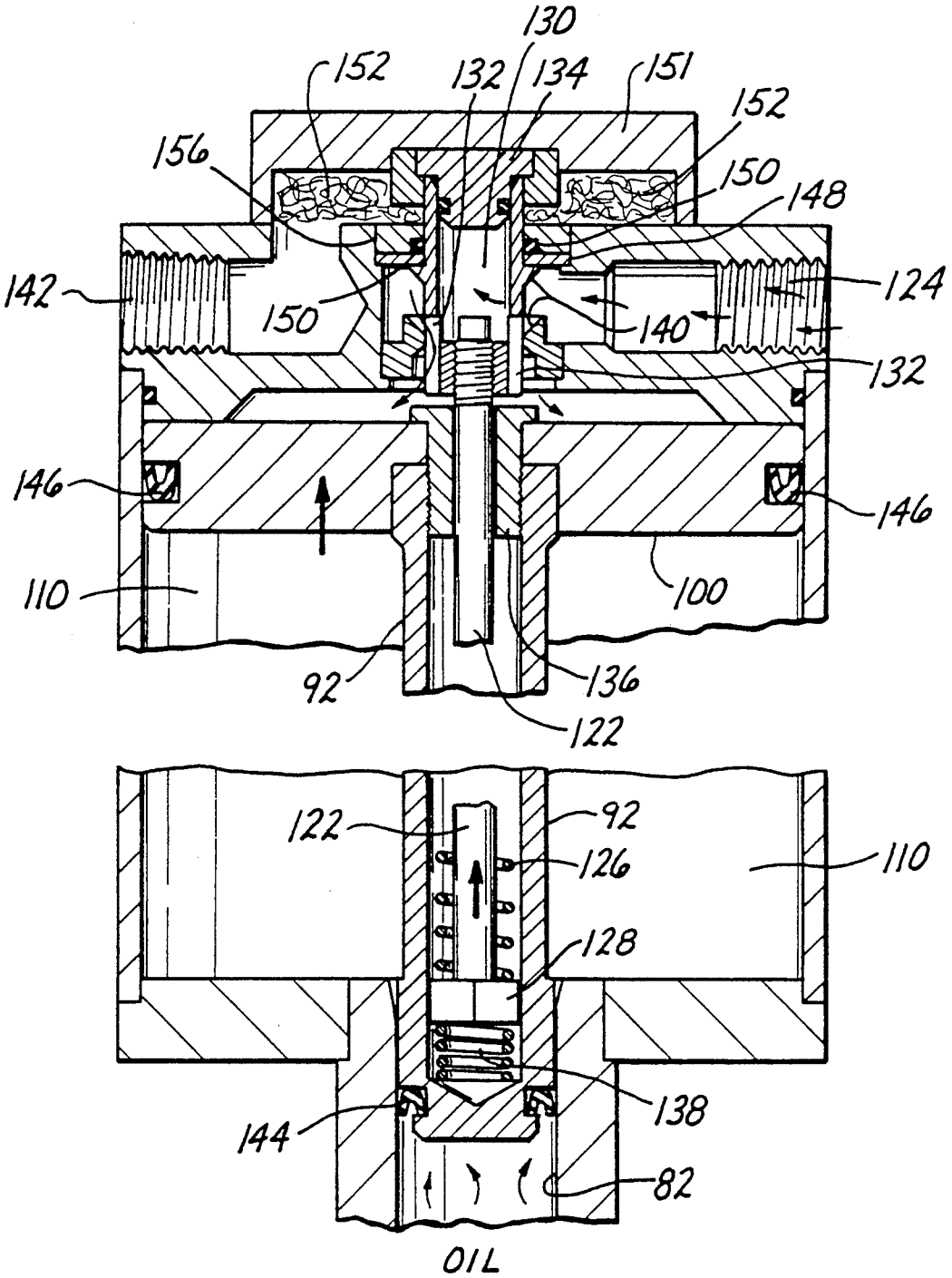
FIG. 5 is an enlarged elevational view, partly in section, taken of air cylinder control valving.
Figure 6:
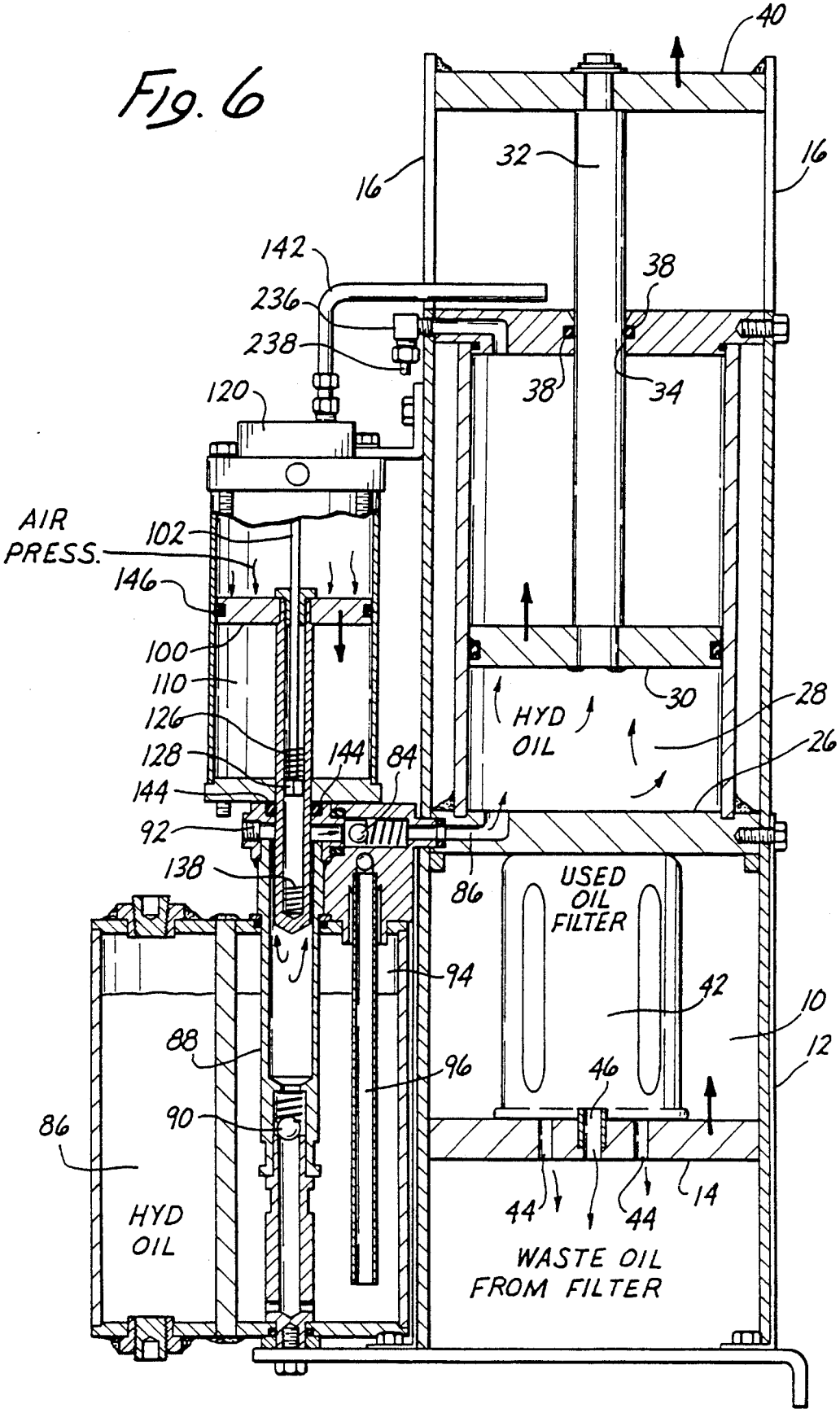
FIG. 6 is like FIG. 4 but parts are in different positions.
Figure 7:
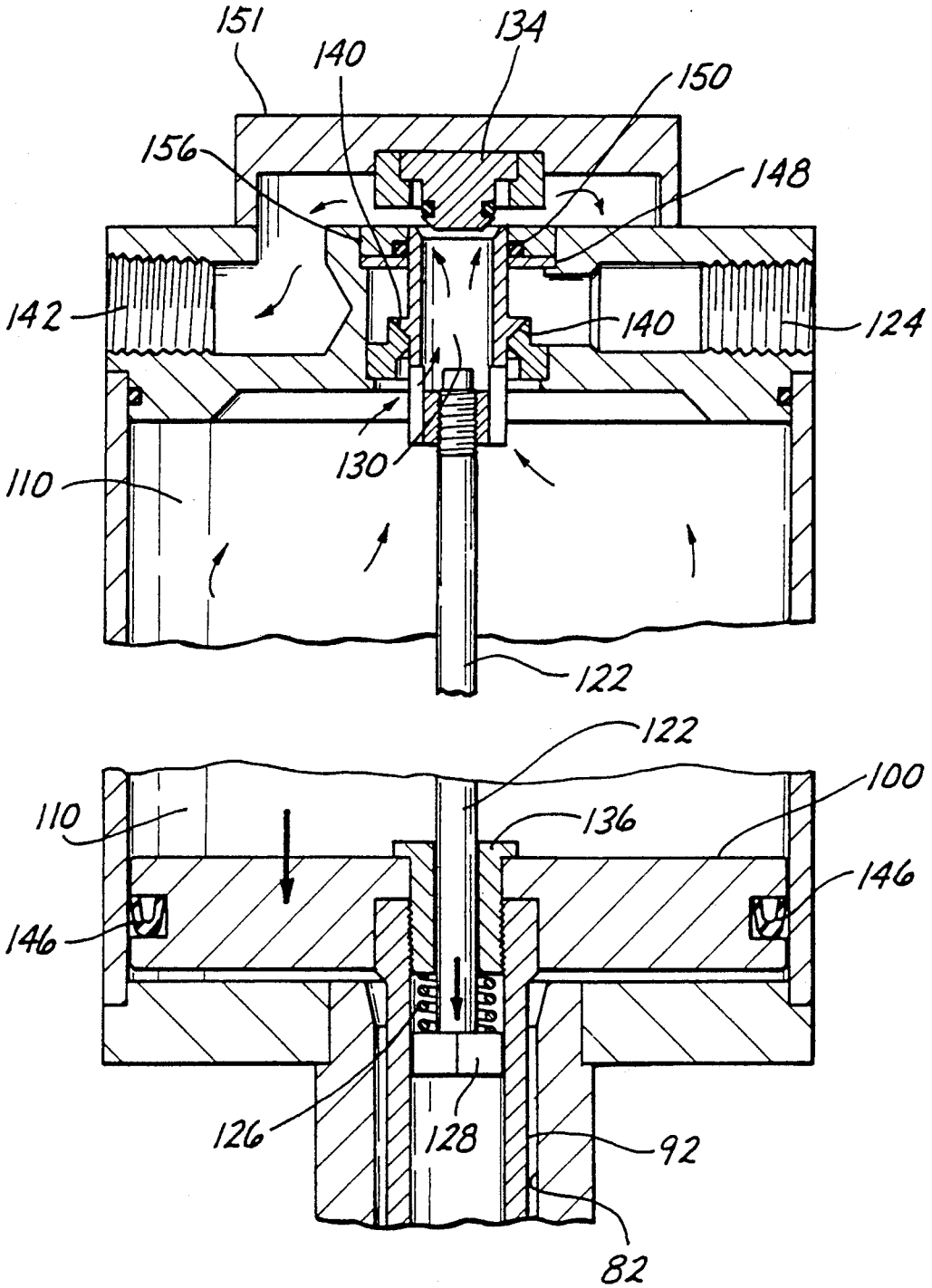
FIG. 7 is like FIG. 5 but parts are in different positions.
Figure 8:
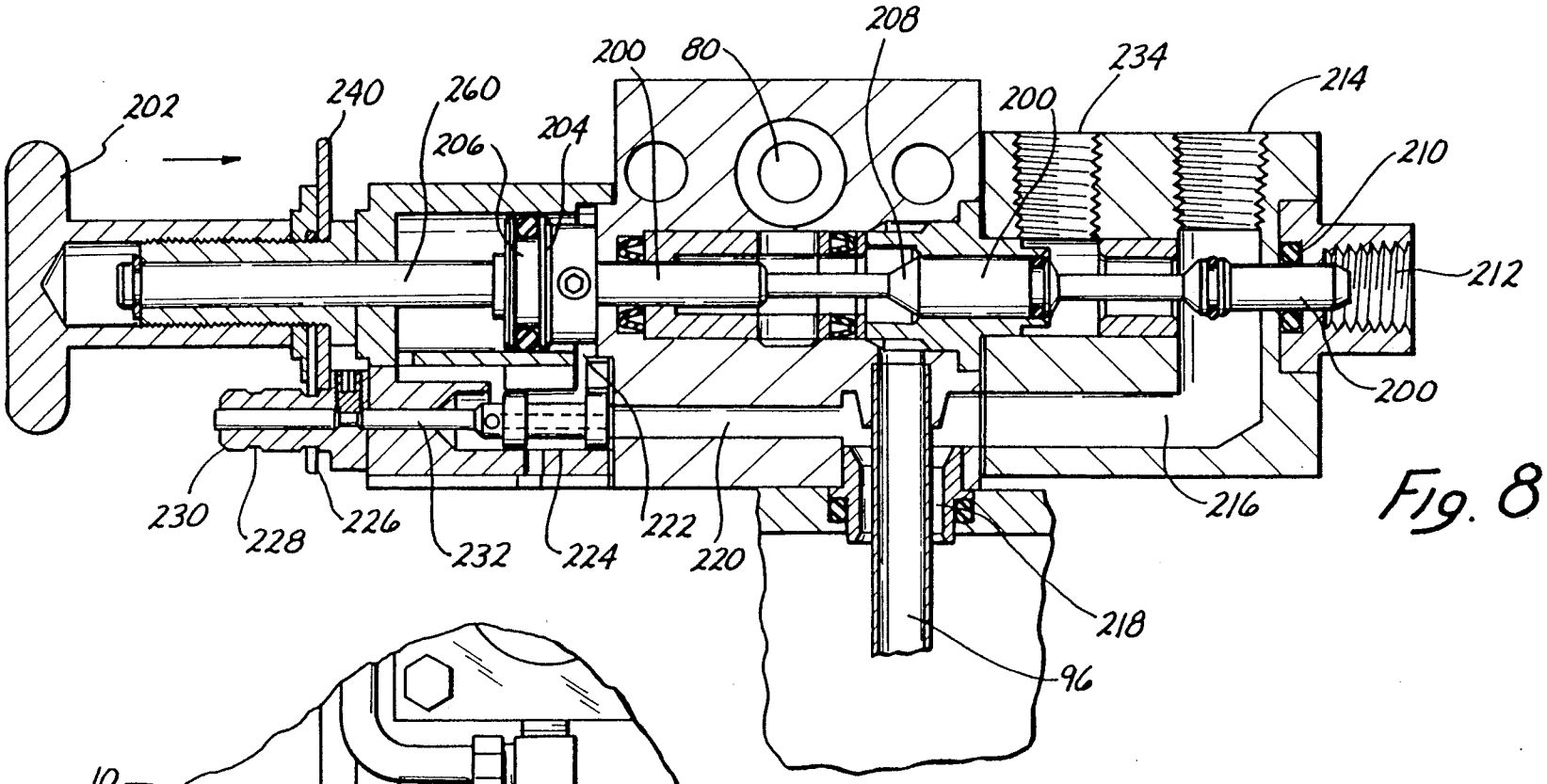
FIG. 8 is like FIG. 3 but the control is in "off" position.
Figure 9:
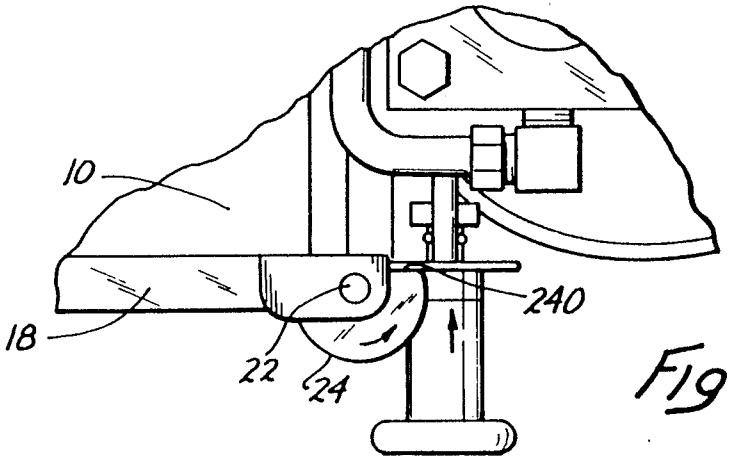
FIG. 9 is a plan view of certain door parts that insure the press is cut off when the door is open.

As before indicated, Federal Law mandates extraction of at least 75% by weight of oil from used automotive oil filters before they are discarded, when they are replaced by new oil filters during periodic automotive service in an automotive service station or in other automotive service facilities. This, of course, is to reduce ground and water pollution from oil from discarded automotive oil filters.

We will describe this specific embodiment of our invention in generally the following order:

(a) the press portion of the invention.
(b) the hydraulic portion of the invention.
(c) the air portion of the invention.
(d) the control portion of the invention.

The used automotive air filters to be pressed vary in sizes. In height, oil filters in some foreign cars are as low as about three inches, and oil filters in some diesel cars or trucks are as high as about eight inches. Oil filter diameters generally vary from about two and three-quarters inch to five inches. Therefore, we prefer to provide a filter-receiving space 10 in press 12 of a size to accomodate filters up to at least eight inches in height and up to at least six inches in diameter.

The bottom of space 10 is defined by bottom press plate 14. The sides of space 10 are defined by a shroud or cage 16 that forms upright draw means. A door 18 in an access opening 20 in shroud 16 to space 10 is hinged to supported bracket P11 at 22. A cam 24 on the hinged side of door 18 acts on press controls to prevent operation of press 12 when door 18 is open.

The top of space 10 is defined by a main hydraulic cylinder bottom plate 26. Main hydraulic cylinder 28 contains a hydraulic piston 30 which has a piston rod 32 exiting through an opening 34 in the main cylinder cap 36 with an appropriate 0-ring seal 38. The upper end of piston rod 32 bears on a top lift plate 40. Top lift plate 40 is used to lift bottom press plate 14 to press a used oil filter 42 against main hydraulic cylinder bottom plate 26 to press filter 42 and to extract oil therefrom. Shroud 16 is welded to bottom press plate 14 and to top lift plate 40 to form the primary structural tie or upright draw means therebetween.

On an average it takes high forces to squeeze an oil filter flat. Our approach is not to ram or press an oil filter down to extract oil but rather to draw the oil filter upwardly against the bottom plate 26 of the main hydraulic cylinder 28. It is believed better to press oil from used oil filter 42 by drawing it up against the bottom of hydraulic cylinder 28, because the forces may be said to be self-contained about cylinder 28, than it would be to extract oil from filter 42 by pressing oil filter 42 downwardly, away from cylinder 28, in which case forces would have to be structurally accomodated as to downward forces on a plate below oil filter 42 and upward reaction forces on cylinder 28. In other words, this unit in order to avoid side thrust and seal leakage of the main hydraulic cylinder, employs an elevator-type cage drawn upwardly compressing the filter between the bottom press plate and the underneath side of the main cylinder thereby minimizing stress exerted within the main cylinder bottom plate.

Bottom press plate 14 has waste oil outlets 44 and a central hollow boss oil outlet 46 that fits in a central opening in oil filter 42 and centers oil filter 42 during the pressing operation.

Press 12 is adapted to mount on a standard 55 gallon barrel or drum 50 that is commonly used to collect oil waste in an automotive service station or other automotive service facility. The oil outlets 44, 46 are superposed to a small inlet 52 in the top of barrel 50 to drain into the same. This is at one side of the top of barrel 50 and press 12 is mounted so it will not cover a larger inlet 54 diametrically opposite in the other side of the top of barrel 50, so that barrel 50 can have its normal general oil waste disposal function in an automotive service facility to receive oil drained from vehicles. In other words, an automotive service facility always will have one or more oil waste disposal barrels 50 and press 12 can be mounted on an oil waste disposal barrel 50 so that no extra floor space is required in the automotive service facility to accomodate the oil filter press function. Floor space is usually at a premium, especially in an automotive service station, so it is important that press 12 can be mounted on the top of one of the ever-present waste oil disposal drums.

Press 12 is attached to barrel rim 60 by a pair of bracket arms 62 with clamps 64 at their ends fitting over rim 60 and secured by thumb screws 66.

A tray or pan 70 is adjustably secured under oil outlets 44, 46 by flanges (not shown) and pan 70 has an outlet 74 that can be superposed to barrel inlet 52, so that extruded oil can be guided into inlet 52.

We now will describe aspects of the hydraulic portion of the invention. An inlet and outlet passageway 80 leads to the bottom of main hydraulic cylinder 28 on the underside of piston 30. A pump compression chamber 82 formed by a cylindrical hollow pump body connects to passageway 80 and there is an interposed spring-pressed ball check valve 84 preventing flow back into chamber 82. An oil inlet to chamber 82 is from a hydraulic fluid reservoir 86 therebelow through an oil inlet tube 88. A spring-pressed ball check valve 90 is interposed to prevent flow directly from chamber 82 to reservoir 86.

A cylindrical pump shaft 92 reciprocates in chamber 82. During a downward pressure stroke of shaft 92, hydraulic fluid is forced past check valve 84 through passageway 80 to the underside of piston 30. During an upward intake stroke of shaft 92, hydraulic fluid passes from reservoir 86 through inlet tube 88 past check valve 90 to chamber 82. As later will be further explained, air pressure applied to fluid in reservoir 86 through air inlet and outlet 94 forces fluid upwardly through tube 88 during the intake stroke of shaft 92. Oil can be returned from main cylinder 28 to reservoir 86 through an oil return tube 96 by connection to passageway 80 as governed by control means later to be described. Reservoir 86 is sealed during operation except for connections to oil inlet tube 88 and to oil return tube 96 and to air inlet and outlet 94.

Pump shaft 92 produces high pressures in main hydraulic cylinder 28 and produces a high lifting force on top lift plate 40 due to a number of factors including (a) multiple strokes, (b) a larger diameter on the air piston 100 powering shaft 92, (c) a smaller diameter of pumping chamber 82, and (d) a larger diameter of main hydraulic chamber 28. The diameter of air piston 100 is at least several times the diameter of pumping chamber 82. The source of low pressure air 102 is about 125 psi and about 2000 psi is adequate in main hydraulic cylinder 28 to adequatly collapse used oil filters 44 and to extract in excess of 75% of the used oil therein.

We will now describe the air portion of the invention. Most automotive service stations and other automotive service facilities have a source 102 of what is commonly termed "low pressure air" at about 150 psi. The common availability of low pressure air, which is used for various purposes in an automotive service facility including filling automotive tires, powering air torque wrenches, etc., is a good reason to use it to power our press 12 because no extra equipment expense is required to generate an adequate input of power for press 12.

Air from source 102 connects to press 12 through a hose 104 to air inlet 106. Connection is made through the common collet type of air connection fitting 108. Interposed between air inlet 106 and air cylinder 110 are an air filter regulator 112, an air mist oiler 114, and an air regulator 116.

The sequence of strokes of air piston 100 in air cylinder 110 is partly controlled by air valve means 120 which acts responsive to the movement of an air valve sequencing shaft 122 associated with air piston 100 and alternately applying air pressure to air piston 100 to cause the pressure stroke of pump shaft 92 and to relieve air pressure from air piston 100 in the intake stroke of pump shaft 92.

A force moving air piston 100 upwardly is hydraulic pressure from hydraulic reservoir 86 acting on pump shaft 92 to which air piston 100 is attached. Air pressure to hydraulic reservoir 86 is responsible for the hydraulic fluid pressure in reservoir 86 that drives pump shaft 92 upwardly once air pressure on the top of air piston 100 is relieved.

Air pressure to the top of air piston 100 is applied through air cylinder inlet 124 to cause a power stroke. As hydraulic pressure from reservoir 86 previously forces air cylinder piston 100 upwardly to its maximum position, a bottom sequencing compression spring 138 forces sequencing valve plunger 130 to its maximum upward position allowing air to flow through air inlet 124 through passages 132 to exert force downwardly on air piston 100. Air also flows through the passage in the hollow plunger 130 until it is restricted in a seal retainer and port fitting 134. Air pressure on top of air piston 100 then forces it downwardly to a point at which piston nut and guide 136 makes contact with top sequencing valve spring 126. When sufficient force has been exerted, sequencing plunger 130 is drawn downwardly closing off air flow to air cylinder 110 at the seat formed by coacting wedging surfaces 140 and simultaneously allowing air to be exhausted through air outlet 142.

Exhausted air containing oil from air mist lubricator 114 is directed through outlet 142 to a point between top lift press plate 40 and main hydraulic cylinder cap 36 thus reusing lubricating oil to lubricate press shroud and stay bars. When sufficient air is exhausted, pressure from air reservoir 86 exerting force against pump shaft 92 and pump seal 144 in pump chamber 82 urges piston shaft 92 upwardly to its original position, thereby beginning a new cycle.

Parts of air valve means 120 include; sequencing shaft 122, sequencing valve nut 128, bottom sequencing valve spring 138, top sequencing valve spring 126, piston nut and guide 136, air piston seal 146, air sequencing plunger 130, air sequencing seat 140, retaining washer 148, plunger seal 150, seal retaining and port fitting 134, sequencing valve cap 151, silencing material 152, and plunger guide 156. Bottom spring 138 is located below air valve plunger shaft 122. Shaft 122 acts against the lower portion of air valve plunger 130 forcing it upwardly thereby sealing the exhaust outlet and allowing air to flow into the air cylinder 110 past plunger 130. This forces the air piston 100 downwardly. Pump shaft 92 is hollow and sequencing air valve shaft 122 is housed within pump shaft 92. Air piston 100 is fixed to the upper end of pump shaft 92. Bottom sequencing spring 138 is located at the lower end of the cavity 158 in pump shaft 92. The upper end of sequencing shaft 122 is secured to plunger 130. Sequencing shaft 122 is slidable within piston nut and guide 136.

We will now describe the main control portion of the invention. First generally describing the control system, it includes a control shaft 200 that shifts longitudinally thereof between "on" and "off" positions. Shaft 200 is brought to an "on" position by manual pulling of a control knob 202, whereupon conversion means is put into operation converting between relatively low psi air pressure from air source 102 (i.e., around 125 psi) to relatively high psi hydraulic pressure (i.e., around 2000 psi) in the pump cycle in which the relatively low psi air pressure is used in multiple strokes to pump up to the relatively high psi hydraulic pressure that is applied to main hydraulic cylinder 28.

Operation of the air-hydraulic conversion means ceases operation when control knob 202 is pushed in to an "off" position. This can be done by striking knob 202 in a "panic" situation. The control system is also brought to an "off" position, when access foor 18 is opened, by means of cam 24 attached or connected at door 18.

Operation of air-hydraulic conversion means also ceases operation by control shaft 200 being automatically moved to an "off" position when a predetermined maximum pressure is achieved in main hydraulic cylinder 28 which is a pressure sufficient to crush used air filters 42 and is a pressure low enough to avoid structural damage to press 12. This automatic shut-off is achieved by the relationship between (a) a first larger surface 204 (exposed to air pressure from air source 182 at about 125 psi) connected to control shaft 200 (the right hand surface as viewed of piston 206), and (b) a second smaller surface 208 connected to control shaft 200 (exposed to the level of hydraulic pressure in main hydraulic cylinder 28). The automatic shut-off is a function of control shaft and associated parts design so that when hydraulic pressure on surface 208 reaches a selected level, i.e., 2000 psi, the air pressure on surface 204 is overcome and control shaft 200 is moved to the right as viewed and the spool valve 224 is shifted to relieve air pressure from the right side 204 of piston 206 and to apply air pressure to the left side of piston 206 whereupon control shaft 206 is moved to the right to seal inlet 212 at 210.

Reviewing the control system in greater detail, when the "on-off" control knob 202 is drawn outwardly to an "on" position, the following sequence takes place: An air inlet seal 210 is withdrawn from an air inlet passage 212 allowing air to flow through air inlet passage 212, air outlet 214 to air cylinder 110, air passageway 216, air outlet 218 to reservoir 86 (disposed annularly around reservoir oil return tube 96), air passageway 220, and air port 222.

The act of drawing control knob 202 outwardly also moves spool valve 224 outwardly because of the connection of knob 202 and spool valve 224 by a spring clip 226 and a groove 228 in a boss 230 attached to the spindle 232 of spool valve 224. The outward position of spool valve 224 allows air to pass to port 222. Air through port 222 on surface 204 forces piston 206 into its position furthest to the left as viewed and air pressure holds piston 206 and control shaft 200 in the position furthest to the left as viewed until sufficient hydraulic force on surface 208 of control shaft 200 overcomes the air pressure on piston 206. In that case, control shaft 200 only needs to be moved a short distance for spool valve 224 (moving with control shaft 200) to be moved to a position to the right as viewed which allows air to be cut off and exhausted from the right side 204 as viewed of piston 206 and allows air to the left side as viewed of piston 206 exerting pressure on control shaft 200 to move to the right as viewed. When control shaft 200 moves to the right as viewed, air inlet passage 212 is closed by the sealed portion 210 of control shaft 200. This also allows air to escape from reservoir 86 through passageway 216, from air cylinder 110 through air outlet 214 and out exhaust 234. At this time the only air being applied (at low pressure) is to assist in the return of main hydraulic cylinder 28 through low pressure return air inlet 236 (at the top of main hydraulic cylinder 28) connected by line 238 to air regulator 116.

Cam 24 connected to door 18 acts to shut off operation of press 12 by moving the control shaft in, to the right as viewed, by acting on spool valve to move inward to the right by force on member 240 associated with spring clip 226.

Hydraulic pressure is applied within the control by connection to the main hydraulic cylinder inlet-outlet 80. In the "on" position of control shaft 200, oil pressure is applied to smaller surface 208 of control shaft 200 so that the control shaft will be moved to "off" position when the hydraulic pressure reaches a high enough level. In the "off" position of control shaft 200, hydraulic fluid from the inlet-outlet 80 connects to the oil return tube 96 for return to reservoir 86.

It is not strictly accurate to talk about the area of surface 208 of control shaft 200 as governing the amount of hydraulic pressure on control shaft 200 because there is an oppositely facing control shaft surface 209 also subjected to hydraulic pressure, so the hydraulic force on control shaft 200 is responsive to the area of surface 208 less the surface of area 209.

Air pressure is supplied from inlet to the hydraulic compression chamber, hence through passage 80, to initiate the beginning movement upwardly of the main hydraulic cylinder 28, thus causing the press assembly to move upwardly until the top of the air filter 42 makes contact with the bottom plate 26 of hydraulic cylinder 28. This action results in a saving of both time and wear of the air cylinder mechanism which otherwise would require many strokes of the pumping unit to achieve the same action. By applying in excess of 100 psi to the underneath side of the hydraulic piston 30, about one ton of lifting force can be exerted (for example, 100 psi air force this a piston area of 19.64 square inches).

Air filter regulator 112 should have a maximum air output of 125 psi and air regulator 116 should be pre-set to an air pressure less than 25 psi.

In order to not confuse this description with unneeded details, we have not specifically described some obvious and secondary structural or other matters illustrated, such as fastening bolts; many O-ring and other seals; matters of manufacturing economy, necessity or convenience; braces; welds; assembly details; etc. However, economy of manufacture is important to the success of our invention and it is believed a low price will be achieved, within the reach of those automotive service facilities needing our press, if the manufacturing details shown are followed. At the same time, the press should have good characteristics in such matters as quality manufacturing, reliability, low maintenance, ease of service, long life, etc.

Having thus described our invention, we do not wish to be understood as limiting ourselves to the exact details described, but instead wish to cover those modifications thereof that will occur to those skilled in this art upon examining our disclosure and which are properly within the scope of the following claims.

We claim:

1. Means in an automotive service facility to extract oil from a used automotive oil filter, comprising:

(a) said service facility having an air source of relatively low psi compressed air, (b) a waste disposal container with a top opening, (c) a press supported by said container over said top opening so that oil extracted from said filter by said press will drain into said container through said top opening, (d) said press having an access opening for manual deposit and removal of said filter, (e) said press being operable to squeeze said filter to extract most oil therefrom, (f) a hydraulic source of hydraulic fluid and said press having operating means including air pressure to hydraulic pressure conversion means converting from said relatively low psi compressed air from said air source to relatively high psi hydraulic fluid from said hydraulic source and a hydraulic cylinder powered by said relatively high psi hydraulic fluid and said hydraulic cylinder being capable of operating said press, and (g) said press including a bottom plate on which said filter is deposited positioned below said hydraulic cylinder, upright draw means disposed about said cylinder and having its lower end secured to said bottom plate and a top press lift plate disposed above said cylinder and said upright draw means having its upper end secured to said top press lift plate, a piston in said cylinder and a piston rod extending upwardly from said piston and having its upper end bearing on said lift plate so that said filter is squeezed between said bottom plate and the bottom of said cylinder when said press is operated by said hydraulic cylinder.

2. The subject matter of claim 1 in which said conversion means has a pump cycle in which said relatively low psi air pressure is used in multiple strokes to increase said hydraulic fluid pressure to said relatively high psi hydraulic fluid which is applied to said cylinder below said piston.

3. The subject matter of claim 1 in which said container is a barrel, said barrel having a second top opening larger than said first-mentioned top opening for deposit of waste into said barrel other than oil from said filter.

4. The subject matter of claim 3 in which said press has support brackets secured to and extending from said press and clamps on the outer ends of said brackets, said barrel having a rim and said clamps clamping to said rim of said barrel.

5. The subject matter of claim 1 in which said press has a door for said access opening, valve means controlling said operating means, and means on said door acting on said operating means to prevent operation of said press when said door is open.

6. Means to extract oil from a used automotive oil filter, comprising:

(a) an air source of relatively low psi compressed air, (b) a waste disposal container, (c) a press supported to drain into said container, (d) said press having an access opening for deposit and removal of said filter, (e) said press being operable to squeeze said filter to extract most oil therefrom, (f) a hydraulic source of hydraulic fluid and said press having operating means including air pressure to hydraulic pressure conversion means converting from said relatively low psi compressed air from said air source to relatively high psi hydraulic fluid from said hydraulic source and a hydraulic cylinder powered by said relatively high psi hydraulic fluid and said hydraulic cylinder being capable of operating said press, and (g) said conversion means having a pump cycle in which said relatively low psi compressed air is used in multiple strokes to increase said hydraulic fluid pressure to said relatively high psi hydraulic fluid which is applied to said cylinder.

7. The subject matter of claim 6 in which said conversion means includes an air cylinder with a reciprocating air piston, a cylindrical pump shaft having an end attached to said reciprocating air piston and a cylindrical hollow pump body receiving said shaft to reciprocate in said pump body as said air piston reciprocates in said air cylinder, the diameter of said air cylinder being at least several times the diameter of said pump body, a hydraulic reservoir connected to the end of said pump body away from said air cylinder and said hydraulic cylinder being connected to said end of said pump body away from said air cylinder and a check valve between said reservoir and said pump body and a check valve between said hydraulic cylinder and said pump body so that during a pressure stroke of said pump shaft hydraulic fluid is pumped to said hydraulic cylinder and so that during an intake stroke of said pump shaft hydraulic fluid passes from said reservoir into said pump body.

8. The subject matter of claim 7 in which there is control means for said operating means including a control shaft with a on-off control member that initiates operation of said conversion means when said control shaft and said control member are brought to an "on" position, operation of said conversion means ceasing operation when said control shaft and said control member are brought to an "off" position, said control means being operative to bring said control shaft and said control member to said "off" position when a predetermined maximum hydraulic pressure in said hydraulic cylinder is reached, there being a first larger surface connected to said control shaft subjected to said air pressure and there being a second smaller surface connected to said control shaft subjected to said hydraulic pressure.

9. The subject matter of claim 8 in which said control member is a knob manually operated by pulling out on said knob.

10. The subject matter of claim 8 in which said control means includes means to control reciprocation of said air piston including an air valve shaft connected to said air piston and air valve means responsive to movement of said air valve shaft alternately to apply air pressure to said air piston to cause said pressure stroke of said pump shaft and to relieve air pressure from said air piston, said control means applying air pressure to said reservoir to resupply hydraulic fluid to said pump body during said intake stroke of said pump shaft.

11. Means in an automotive service facility to extract oil from a used automotive oil filter, comprising:

(a) said service facility having an air source of relatively low psi compressed air, (b) a waste disposal container with a top opening, (c) a press supported by said container over said top opening so that oil extracted from said filter by said press will drain into said container through said top opening, (d) said press having an access opening for manual deposit and removal of said filter, (e) said press being operable to squeeze said filter to extract most oil therefrom, and (f) a hydraulic source of hydraulic fluid and said press including air pressure to hydraulic pressure conversion means converting from said relatively low psi compressed air from said air source to relatively high psi hydraulic fluid from said hydraulic source and a hydraulic cylinder powered by said relatively high psi hydraulic fluid and said hydraulic cylinder being capable of operating said press, and (g) control means for said conversion means including a control shaft moving end-wise of said shaft between an "on" position and an "off" position and there being a first larger surface connected to said control shaft subjected to said compressed air and a second smaller surface connected to said control shaft subjected to said hydraulic fluid whereby said control shaft is moved to said "off" position when a predetermined hydraulic pressure in said hydraulic cylinder is reached.

* * * * *